US010718193B2

(12) United States Patent
Sultenfuss et al.

(10) Patent No.: US 10,718,193 B2
(45) Date of Patent: Jul. 21, 2020

(54) IN SITU COMBUSTION FOR STEAM RECOVERY INFILL

(71) Applicant: CONOCOPHILLIPS COMPANY, Houston, TX (US)

(72) Inventors: Daniel Ray Sultenfuss, Calgary (CA); Wayne Reid Dreher, Jr., Katy, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 13/973,036

(22) Filed: Aug. 22, 2013

(65) Prior Publication Data

US 2014/0060823 A1 Mar. 6, 2014

Related U.S. Application Data

(60) Provisional application No. 61/693,923, filed on Aug. 28, 2012.

(51) Int. Cl.
*E21B 43/243* (2006.01)
*E21B 43/24* (2006.01)

(52) U.S. Cl.
CPC ..... *E21B 43/243* (2013.01); *E21B 43/2408* (2013.01)

(58) Field of Classification Search
CPC ..... E21B 43/243; E21B 43/2408
See application file for complete search history.

(56) References Cited

U.S. PATENT DOCUMENTS

| | | | | |
|---|---|---|---|---|
| 2,685,930 | A | 8/1954 | Albaugh | |
| 3,428,125 | A | 2/1969 | Parker | |
| 4,166,503 | A * | 9/1979 | Hall | E21B 43/24 166/245 |
| 4,705,108 | A | 11/1987 | Little et al. | |
| 5,339,897 | A | 8/1994 | Leaute | |
| 5,456,315 | A | 10/1995 | Kisman et al. | |
| 2007/0187094 | A1 | 8/2007 | Pfefferle | |
| 2007/0295499 | A1 * | 12/2007 | Arthur | E21B 43/2406 166/245 |
| 2008/0093071 | A1 | 4/2008 | Weiers et al. | |
| 2008/0264635 | A1 | 10/2008 | Chhina et al. | |
| 2009/0044940 | A1 * | 2/2009 | Pfefferle | 166/261 |
| 2009/0194278 | A1 | 8/2009 | De Francesco | |

(Continued)

OTHER PUBLICATIONS

International Search Report (PCT Article 18 and Rules 43 and 44). PCT/US2013/056152. Form PCT/ISA/210 (Jul. 2009) dated Jan. 11, 2014.

*Primary Examiner* — William D Hutton, Jr.
*Assistant Examiner* — Avi T Skaist
(74) *Attorney, Agent, or Firm* — Boulware & Valoir

(57) ABSTRACT

Methods and systems produce petroleum products from a formation by a steam assisted process followed by an in situ combustion process. The steam assisted process utilizes an injector and first producer to form a steam chamber within the formation as the products are recovered. The in situ combustion then starts by injecting an oxidant into the formation and ignition of residual products. A combustion front advances toward a second producer that may be offset in a lateral direction from the first producer. Heat and pressure from the in situ combustion sweeps the products ahead of the combustion front to the second producer for recovery.

9 Claims, 2 Drawing Sheets

(56) References Cited

U.S. PATENT DOCUMENTS

| | | | | |
|---|---|---|---|---|
| 2009/0266540 | A1 | 10/2009 | De Francesco | |
| 2010/0206565 | A1 | 8/2010 | Embry et al. | |
| 2011/0174488 | A1* | 7/2011 | Morris | E21B 43/16 166/305.1 |
| 2013/0062058 | A1* | 3/2013 | Sultenfuss et al. | 166/260 |

* cited by examiner

IN SITU COMBUSTION FOR STEAM RECOVERY INFILL

CROSS-REFERENCE TO RELATED APPLICATIONS

This application is a non-provisional application which claims benefit under 35 USC § 119(e) to U.S. Provisional Application Ser. No. 61/693,923 filed Aug. 28, 2012, entitled "IN SITU COMBUSTION FOR STEAM RECOVERY INFILL," which is incorporated herein in its entirety.

STATEMENT REGARDING FEDERALLY SPONSORED RESEARCH OR DEVELOPMENT

None.

FIELD OF THE INVENTION

Embodiments of the invention relate to producing hydrocarbons by steam assisted processes and in situ combustion.

BACKGROUND OF THE INVENTION

Bitumen recovery from oil sands presents technical and economic challenges due to high viscosity of the bitumen at reservoir conditions. The viscosity of the bitumen prevents the bitumen from flowing in a reservoir. Various stimulation approaches exist to make the bitumen mobile enough for production from a wellbore.

Steam assisted gravity drainage (SAGD) provides one process for producing the bitumen. During SAGD operations, steam introduced into the reservoir through a horizontal injector well transfers heat to the bitumen upon condensation. The bitumen with reduced viscosity due to this heating drains together with steam condensate and is recovered via a producer well disposed parallel and beneath the injector well. Residual bitumen remaining in the reservoir and costs associated with energy requirements for the SAGD operations restrict economic returns.

In situ combustion (ISC) also enables recovery of the bitumen but has returns reduced by expenses to establish fluid communication between wells. For ISC methods, an oxidant injected into the reservoir reacts with the bitumen once ignited to provide a source of heat for mobilizing the bitumen. Since heat, oxygen and fuel must remain available to sustain the reaction, combustion products and mobilized bitumen becoming trapped in the reservoir due to immobility of the bitumen can extinguish the ISC.

Therefore, a need exists for methods and systems for recovering hydrocarbons from oil sands with limited costs given total recovery obtained.

BRIEF SUMMARY OF THE DISCLOSURE

In one embodiment, a method of recovering hydrocarbons includes injecting steam into a formation through a horizontal injection well aligned above a horizontal first production well and recovering the hydrocarbons and steam condensate that drain to the horizontal first production well due to the injecting of the steam such that a steam chamber develops in the formation. In situ combustion after the steam chamber is developed initiates by injecting an oxidizing agent through the injection well and igniting the hydrocarbons remaining in the formation to establish a combustion front. The method further includes recovering the hydrocarbons through a horizontal second production well as the combustion front progresses toward the second production well disposed offset in a lateral direction from the first production well.

According to one embodiment, a method of recovering hydrocarbons includes injecting steam into a formation through a horizontal injection well disposed parallel and aligned above a horizontal first production well for a steam assisted gravity drainage operation in which recovering the hydrocarbons and steam condensate that drain to the first production well due to the injecting of the steam develops a steam chamber in the formation. In situ combustion initiates after the steam chamber is developed by injecting an oxidizing agent into the steam chamber and igniting the hydrocarbons remaining in the formation to establish a combustion front. The method further includes recovering the hydrocarbons through a horizontal second production well as the combustion front progresses toward the second production well.

BRIEF DESCRIPTION OF THE DRAWINGS

A more complete understanding of the present invention and benefits thereof may be acquired by referring to the follow description taken in conjunction with the accompanying drawings.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

For some embodiments, methods and systems produce petroleum products from a formation by a steam assisted process followed by an in situ combustion process. The steam assisted process utilizes an injector and first producer to form a steam chamber within the formation as the products are recovered. The in situ combustion then starts by injecting an oxidant into the formation and ignition of residual products. A combustion front advances toward a second producer that may be offset in a lateral direction from the first producer. Heat and pressure from the in situ combustion sweeps the products ahead of the combustion front to the second producer for recovery.

Figure 1:
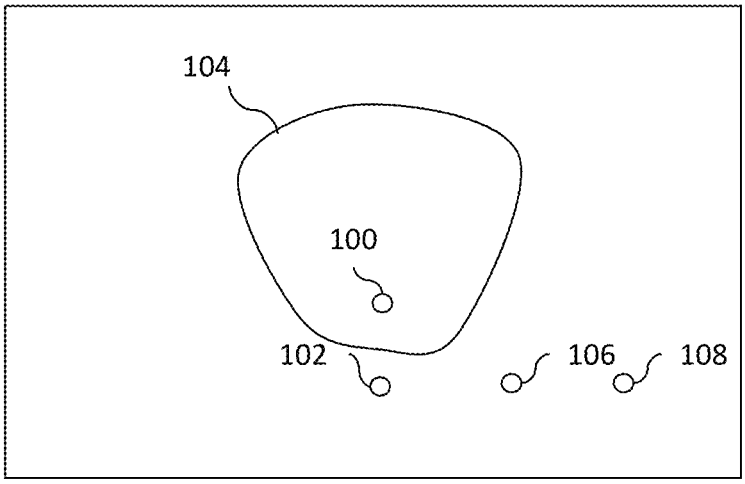
FIG. 1 is a schematic of a steam assisted hydrocarbon recovery operation and additional production wells disposed for subsequent in situ combustion, according to one embodiment of the invention.

FIG. 1 shows an exemplary steam assisted hydrocarbon recovery operation within a formation and that employs an injection well 100 and a first production well 102 to generate a steam chamber 104. A second production well 106 also extends through the formation for use in a subsequent in situ combustion operation. In some embodiments, additional wells, such as a third production well 108, further facilitate recovery with the in situ combustion.

For some embodiments, the wells 100, 102, 106, 108 each include horizontal lengths that pass through the formation and may be disposed parallel to one another. As shown in FIG. 1 viewed transverse to the horizontal lengths, all the production wells 102, 106, 108 may align in a common horizontal plane and may be disposed at a reservoir bottom, such as 1 to 5 meters above a bottom layer bounding the reservoir in the formation. The injection well 100 may align above the first production well 102 with between 3 and 10 meters separating the injection well 100 from the first production well 102.

This configuration of the injection well 100 and the first production well 102 exemplifies a conventional steam assisted gravity drainage (SAGD) well pair. However, the steam assisted process, operation or hydrocarbon recovery as used herein refers to any method, regardless of particular well configuration, in which heated water or steam, used alone or in combination with other solvents and/or gases, is injected into the formation so as to produce the hydrocarbons from that formation. Solvents may include hydrocarbon solvents, such as methane, ethane, propane, butane, pentane, hexane, acetylene, and propene, or solvents containing heteroatoms, such as carbon disulfide ($CS_2$). Other gases may include non-condensable gases (NCGs) such as nitrogen ($N_2$), oxygen ($O_2$), air, $CO_2$, CO, hydrogen ($H_2$), flue gas and combustion gas. Examples of the steam assisted processes include, but are not limited to SAGD, steam assisted gravity push (SAGP), and cyclic steam stimulation (CSS).

In the steam assisted process as depicted, steam passes through the injection well 100 into the formation. The steam rises, forming the steam chamber 104 that slowly grows toward a reservoir top, thereby increasing formation temperature and reducing viscosity of the hydrocarbons. Gravity pulls the hydrocarbons and condensed steam through the formation to the first production well 102 for recovery to surface. At the surface, water and the hydrocarbons can be separated from each other.

The steam chamber 104 refers to a pocket or chamber of gas and vapor formed in the formation. In other words, the steam chamber 104 defines a volume of the formation, which is saturated with injected steam and from which mobilized hydrocarbons have at least partially drained. As the steam chamber 104 expands upwardly and laterally from the injection well 100, viscous hydrocarbons in the formation are heated and mobilized, especially at the margins of the steam chamber 104 where the steam condenses and heats a layer of the hydrocarbons by thermal conduction.

For some embodiments, the injecting of the steam through the injection well 100 and recovery with the first production well 102 occurs for at least two years prior to shutting the first production well 102 and initiating the in situ combustion described herein. Economics of the steam assisted process may determine this duration as production declines and becomes uneconomic to continue generating and injecting the steam. The steam assisted process continues for the duration that is also sufficient to establish fluid communication between any wells used first in the in situ combustion process. For example, the injection well 100 and the second production well 106 may lack the fluid communication necessary for the in situ combustion until after the steam assisted process heats the formation. The steam assisted process may therefore establish this fluid communication without relying on additional heating of the formation from other sources, such as resistive heaters.

For some embodiments, recovery of the hydrocarbons through the second production well 106 may begin while still injecting the steam through the injection well 100 or prior to initiating the in situ combustion. Further, the formation may include the injection well 100 and the first production well 102 forming a first well pair adjacent to a second well pair also used for steam assisted hydrocarbon recovery with the second production well 106, referred to in this case as an infill well, disposed between such pairs. Alternative arrangements may use the second production well 106 with another well to form the adjacent second well pair where lateral spacing is close enough to provide a desired sweep efficiency. In some embodiments, the steam chamber 104 develops to have a lateral edge upon start of the in situ combustion disposed above the second production well 106.

At the end of the steam assisted process conducted in a pattern across the formation, up to forty percent of the hydrocarbons may remain in the formation. Up to ten percent of the hydrocarbons may remain in the steam chamber 104. Higher saturations of the hydrocarbons exist at the lateral edges of the steam chamber 104 targeted for additional recovery by the in situ combustion described herein.

Figure 2:
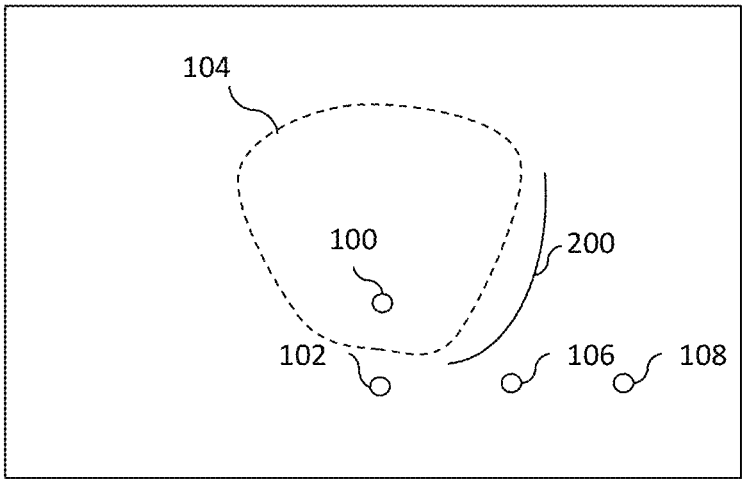
FIG. 2 is a schematic of a combustion front of the in situ combustion propagating toward the production wells, according to one embodiment of the invention.

FIG. 2 illustrates a combustion front 200 of the in situ combustion propagating toward the second production well 106. For the in situ combustion, a combustion reaction initiates as oxidizing agent is introduced into the formation in order to consume some of the hydrocarbons that remain in the formation following the development of the steam chamber 104, The steam chamber is depicted as a dashed line in FIGS. 2 and 3 where the chamber was last formed by steam even though perhaps not distinguishable from growing burned area behind the combustion front depicted as a solid line 200. Examples of the oxidizing agent include, but are not limited to, oxygen, air and oxygen-enriched air.

In some embodiments, injecting of the oxidizing agent into the formation occurs through the injection well 100 and may be injected into the steam chamber 104. The combustion front 200 propagates away from the injection well 100 in a direction transverse to the horizontal length of the second production well 106. However, other horizontal or vertical wells may introduce the oxidizing agent into the formation such that the combustion front advances through at least part of the steam chamber 104 toward the second production well 106. For example, a separate vertical well disposed at a toe of the second production well 106 may enable a toe to heel in situ combustion operation with respect to the second production well 106.

Heat from the combustion front 200 further reduces viscosity of the hydrocarbons at the lateral edges of the steam chamber 104. Recovering through the second production well 106 the hydrocarbons that are heated, removes lower viscosity liquefied hydrocarbons and encourages in situ combustion as injecting of the oxidizing agent continues. As the combustion front 200 advances, a bank of the hydrocarbons remaining in the formation and ahead of the combustion front sweeps toward the second production well 106 for recovery.

Figure 3:
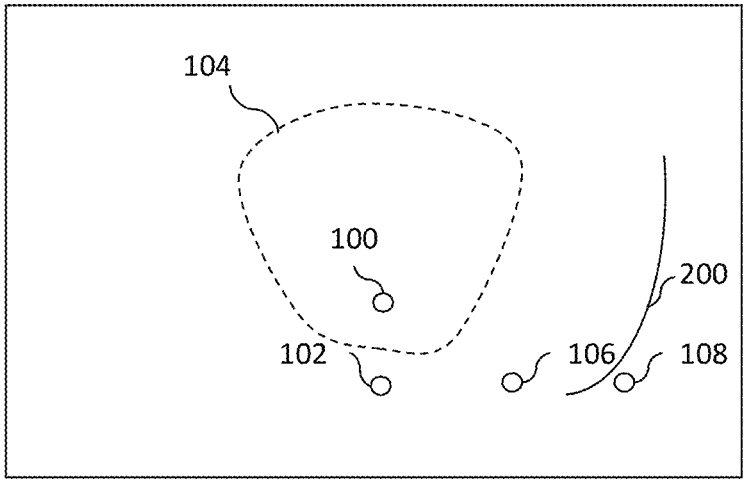
FIG. 3 is a schematic of the combustion front once advanced past a first of the production wells, according to one embodiment of the invention.

FIG. 3 shows the combustion front 200 once advanced past the second production well 106, which is then shut. The combustion front 200 after passing the second production well 106 propagates toward the third production well 108. Staging of the second and third production wells 106, 108 helps ensure that the distance is not too great for the oxidizing agent injected to get the desired sweep efficiency given limited mobility of the hydrocarbons still in the formation and potential area of the formation desired to be swept. Like the second production well 106, the third production well 108 also recovers the hydrocarbons that are heated and swept ahead of the combustion front 200 but that are in an area of the formation further from the injection well 100 than the second production well 106.

For some embodiments, the in situ combustion ends with pressurization of the formation back to initial pressure of the formation prior recovering of the hydrocarbons. Generation of combustion gasses with the in situ combustion process along with use of associated compression equipment employed with the in situ combustion facilitates achieving this pressurization of the formation. The pressurization enables meeting any government regulations for abandonment that may be required.

Figure 4:
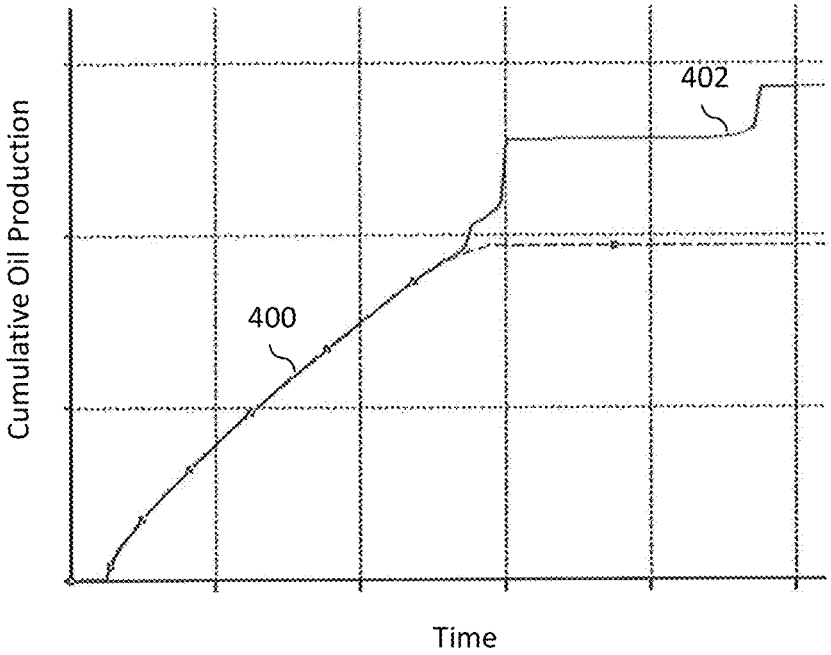
FIG. 4 is a graph of cumulative oil production versus time with a plot of simulated results based on approaches shown in FIGS. 1-3, according to one embodiment of the invention.

FIG. 4 depicts a graph of cumulative oil production versus time with a plot of simulated results based on approaches shown in FIGS. 1-3. A first curve 400 corresponds to an initial period of time associated with only the steam assisted production that is ended once uneconomic as indicated where the curve 400 transitions to dashes. A second curve 402 corresponds to an additional recovery period of time associated with the in situ combustion. In this simulation, the in situ combustion provides an additional 15% recovery of the hydrocarbons compared to stopping of the steam assisted production when uneconomic.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. A method of recovering hydrocarbons from a reservoir, said method comprising:

i. providing at least one first well pair comprising a horizontal injection well above and parallel to a horizontal production well positioned at a bottom of a heavy hydrocarbon reservoir;

ii. providing a first unpaired horizontal infill well parallel to said production well and positioned at said bottom, but laterally offset from said production well, and providing a second unpaired horizontal infill well at said bottom and further offset in a lateral direction than said first infill well;

iii. injecting steam into said injection well to form a steam chamber and mobilize heavy hydrocarbons in said reservoir;

iv. recovering mobilized hydrocarbon and steam condensate from said production well for a period of time until production becomes uneconomic;

v. ceasing steam injection and shutting said production well;

vi. initiating in situ combustion by injecting an oxidizing agent into said injection well and igniting remaining hydrocarbon to establish a combustion front that progresses away from said injection well and towards said first infill well as injection of said oxidizing agent continues, thereby sweeping additional mobilized hydrocarbon towards said first infill well;

vii. recovering additional mobilized hydrocarbon from said first infill well;

viii. shutting said first infill well when said combustion front passes said first infill well; and ix. recovering additional mobilized hydrocarbon from said second infill well, wherein more hydrocarbon is produced with said combustion front than is produced in a similar method that does not use said combustion front.

2. The method according to claim 1, wherein said first infill is disposed between said first well pair and a second well pair comprising a second injection well above and parallel to a second production well at said bottom.

3. The method according to claim 1, wherein the method is ended by shutting in all wells and repressurizing said reservoir back to an initial pressure of said reservoir.

4. The method according to claim 1, wherein said period of time is at least two years.

5. The method according to claim 1, wherein said oxidizing agent includes at least one of air, oxygen and oxygen-enriched air.

6. The method according to claim 1, wherein the injection of steam establishes fluid communication between said injection well and said first infill well without additional heating of the formation.

7. The method according to claim 1, wherein recovering mobilized hydrocarbons and steam condensate through said first infill well also occurs during the injecting of the steam.

8. The method according to claim 1, wherein said first infill well is used in a steam assisted hydrocarbon recovery operation adjacent to the steam chamber prior to initiating in situ combustion.

9. The method according to claim 1, wherein said first infill well is disposed below a lateral edge of the steam chamber at initiating in situ combustion.

* * * * *